US006427994B1

(12) United States Patent
Stodolka

(10) Patent No.: US 6,427,994 B1
(45) Date of Patent: Aug. 6, 2002

(54) SUPPORT DEVICE FOR EXHAUST PIPE TIPS

(76) Inventor: John Thomas Stodolka, 13843 Guild Ave., Apple Valley, MN (US) 55124

( * ) Notice: Subject to any disclaimer, the term of this patent is extended or adjusted under 35 U.S.C. 154(b) by 0 days.

(21) Appl. No.: 09/632,183

(22) Filed: Aug. 3, 2000

(51) Int. Cl.[7] ..... B25B 1/22
(52) U.S. Cl. ..... 269/43
(58) Field of Search ..... 269/43, 45, 299, 269/902, 37, 71, 76; 29/281.1, 281.5

(56) References Cited

U.S. PATENT DOCUMENTS 568,543 A * 9/1896 Parks ..... 269/45
2,175,974 A * 10/1939 Shurtz ..... 269/45
4,253,649 A * 3/1981 Hewson ..... 269/45
5,118,024 A * 6/1992 McClure ..... 269/43

* cited by examiner

*Primary Examiner*—Robert C. Watson
(74) *Attorney, Agent, or Firm*—Herman H Bains

(57) ABSTRACT

A support device for supporting an exhaust pipe tip during replacement of an exhaust pipe tip includes an elongate frame member. A exhaust pipe attachment member having clamping bolts for clamping to an exhaust pipe is pivotally connected to the frame member for pivoting movement of the frame about a vertical axis. An exhaust pipe tip support member is attached to the outer end of the frame member for vertical adjustment relative thereto, and serves to support to support the exhaust pipe tip.

9 Claims, 1 Drawing Sheet

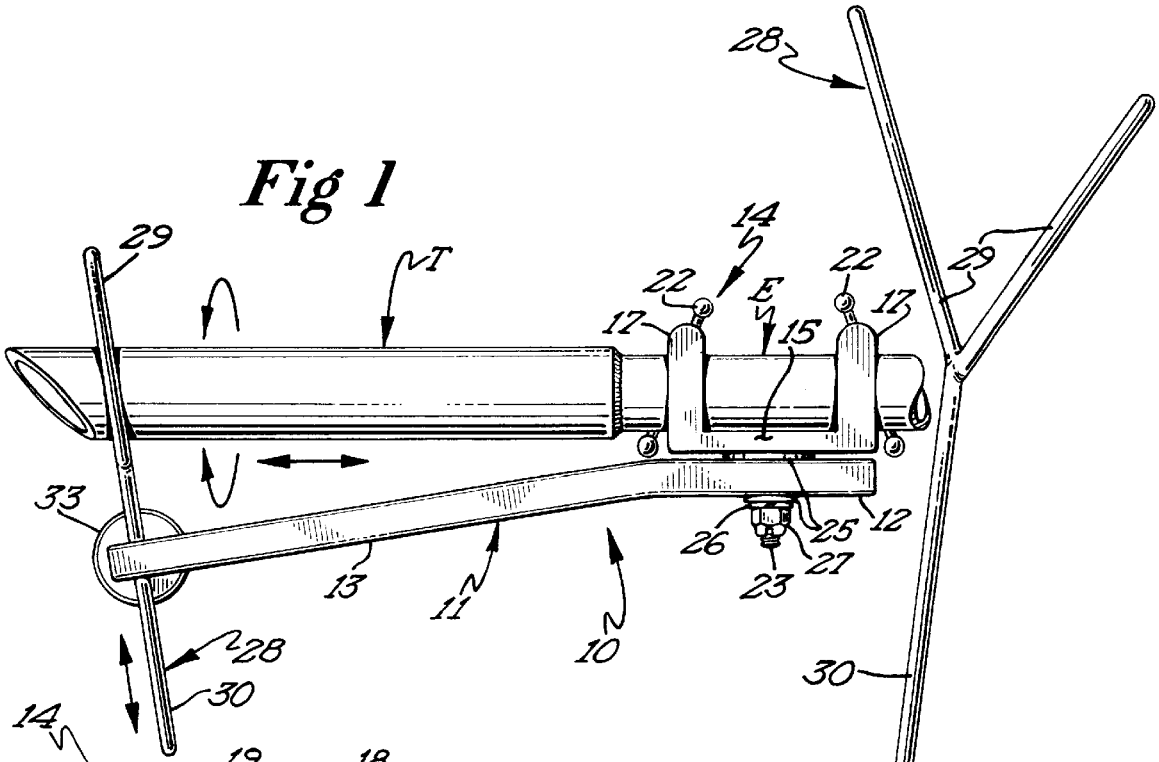
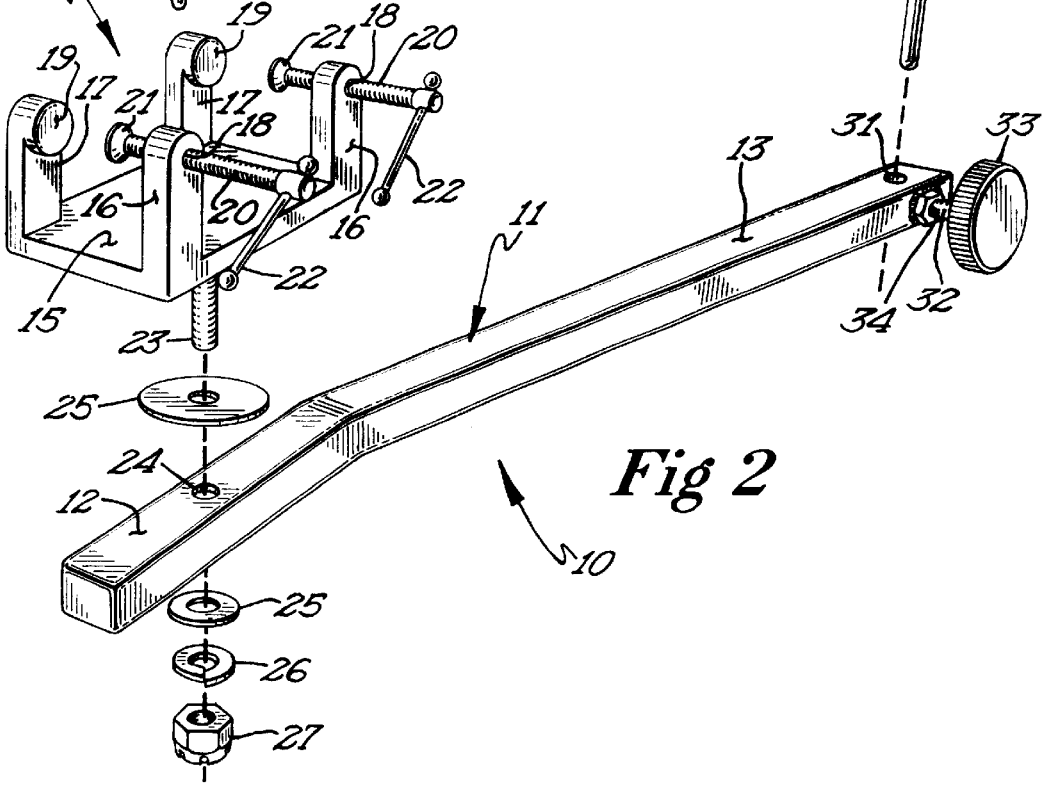
Fig 2

SUPPORT DEVICE FOR EXHAUST PIPE TIPS

FIELD OF THE INVENTION

This invention relates to a support device for supporting an exhaust pipe tip during replacement of the exhaust tip.

BACKGROUND OF THE INVENTION

In many automotive vehicles, the exhaust pipe or tailpipe is provided with an exhaust tip. The exhaust tip or tailpipe extender may be chrome plated or otherwise has a more appealing appearance than the exhaust pipe. However, the exhaust pipe tip is often replaced due to damage or wear.

Replacement of the exhaust pipe tip usually requires two people, one to hold and align the exhaust tip, and the other to weld the exhaust tip to the exhaust pipe. Even though the exhaust tip is telescoped over the end of the exhaust pipe, accurate alignment of the exhaust pipe tip is difficult.

SUMMARY OF THE INVENTION

An object of this invention is to provide a device for supporting a exhaust pipe tip during replacement of the tip to permit accurate alignment of the tip with the exhaust pipe while eliminating the labor intensive requirement under present replacement procedures.

The support device is clamped to an exhaust pipe and is provided with a support member which supports the exhaust pipe tip during replacement of the tip. The support device may be readily and quickly applied to the exhaust pipe and quickly welded by a single worker. Further, the support device is variously adjustable thereby permitting accurate positioning and alignment of the exhaust pipe tip with respect to various configured exhaust pipe systems.

BRIEF DESCRIPTION OF THE FIGURES OF THE DRAWINGS

FIG. 1 is a side elevational view of the novel support device illustrated in supporting relation to an automotive vehicle exhaust pipe tip; and FIG. 2 is an exploded perspective view of the novel support device illustrating details of construction of the components thereof.

DESCRIPTION OF THE PREFERRED EMBODIMENT

Referring now to the drawing, it will be seen that one embodiment of the novel support device, designated generally by the reference numeral 10, is thereshown. The support device 10 supports an exhaust pipe tip T during replacement of the exhaust pipe tip. The support device 10 includes an elongate frame member 11 which is of rectangular cross-sectional configuration. The frame member 11 includes an inner end portion 12 and an outer end portion 13.

It will be noted that the frame member 11 is bent such that the outer end portion 13 extends downwardly and outwardly from the inner end portion 12. It will also be noted that the inner end portion 12 of the frame member 11 constitutes only a small portion of the overall length of the frame member. The bent configuration of the frame member 11 allows the outer end portion 13 to clear and extend below the rear end of a vehicle.

The support device 10 also includes an exhaust pipe attachment member 14 which comprises a flat, generally rectangular base plate 15. The base plate 15 has a pair of longitudinally spaced apart posts 16 and a pair of longitudinally spaced apart posts 17 integral therewith and extending upwardly therefrom. Each post 16 is disposed in laterally aligned relation with a post 17. Each post 16 has a threaded opening 18 therein and each post 17 is provided with an inwardly projecting element having a flat face 19. A pair of elongate threaded clamping bolts 20 each threadedly engage a threaded opening 18 in a post 16. Each clamping bolt 20 is provided with a clamping pad 21 at its inner end and each bolt is provided with an elongate actuating handle 22 which extends through an opening in the outer end thereof.

A vertically disposed, elongate, threaded pivot bolt 23 has its upper end affixed to the central portion of the base plate 15 and depends therefrom, the pivot bolt 23 extending downwardly through an opening 24 in the inner end portion 12 of the frame member 11. Washers 25 engage the pivot bolt on opposite sides of the frame member 11. A lock washer 26 and lock nut 27 allow the pivot bolt and exhaust pipe attachment member to be clamped in an adjusted position. It will be noted that the frame member 11 presents flat opposed surfaces and that the exhaust pipe attachment member is secured to the upper surface of the inner end portion 12 of the frame member 11. Finally, it will be noted that the length dimension of the exhaust pipe attachment member 14 corresponds to the length of the inner end portion 12 of the frame member 11.

The support device also includes a tailpipe tip support member 28 including a V-shaped element 29 having an elongate shank 30 affixed to the apex of the V-shaped element 29 thereby giving the support member 28 a Y-shaped configuration. The shank 30 projects downwardly through an opening 31 in the outer end portion 13 adjacent the outer end thereof. A threaded locking bolt 32 threadedly engages a threaded opening 34 in the outer end portion 13 of the frame member and engages the shank 30 of the support member 28 to lock the support member in a vertically adjusted position. The locking bolt 32 is provided with an enlarged actuating knob 33 for readily shifting the locking bolt into and out of engaging relation with the shank 30.

In use, attachment member 14 will be attached to the exhaust pipe E after the worn or damaged exhaust pipe tip has been removed. The clamping bolts 20 ill clamp the exhaust pipe E against the faces 19. The lock nut 27 will be loosened to permit pivoting of the frame member 11 to the desired position. The nut 27 will be tightened thereby securing the frame member 11 in the desired adjusted position. The replacement exhaust pipe tip T will be telescoped over the end of the exhaust pipe E and the support member 28 will be adjusted to the desired height.

The frame member may then be shifted laterally for fine positioning while the Y-shaped su port may be further adjusted. During replacement of the exhaust pipe tip, the exhaust pipe tip T is firmly supported while allowing the necessary adjustments to be made for accurate positioning. It will be seen that the exhaust pipe tip may be longitudinally shifted, rotated, angularly and vertically adjusted while the exhaust pipe tip is firmly supported in telescoped relation with the exhaust pipe E. The support device permits a single worker to remove, replace and accurately position the exhaust pipe tip. After proper adjustment, the worker will weld the exhaust pipe tip T to the exhaust pipe E in the conventional manner.

It will be appreciated that the angular adjustment of the frame member 11 about a vertical axis relative to the exhaust pipe permits support of the exhaust pipe tip regardless of the configuration of the exhaust pi e. The support device 10 may be applied to an exhaust pipe and exhaust pipe tip in a relatively short time, typically in a minute or less. The support device allows a single worker (rather than a two person operation) to replace and accurately align a d position an exhaust pipe tip. The time required to replace a exhaust pipe tip using the novel support device 10 is substantially less than the time required using the conventional methods of replacement.

Thus it will be seen that my novel support device not only allows accurate alignment and positioning of a replacement exhaust pipe tip but permits reads and rapid replacement of the exhaust pipe tip by a single worker.

What is claimed is:

1. A support device for supporting and permitting accurate alignment and attachment of an exhaust pipe tip to an exhaust pipe of an automotive vehicle, comprising an elongate frame member having an inner end portion and an outer end portion, an attachment member, means pivotally connecting the attachment member to the inner end portion of the frame for pivoting movement of the attachment member about a vertical axis, clamping means on the attachment member for clamping engagement with an exhaust pipe of a vehicle, a vertically adjustable exhaust tip support member for supporting an exhaust tip during replacement thereof, said exhaust tip support member being connected to the outer end portion of the frame member whereby said support device permits vertical adjustment and pivoting of the exhaust pipe and exhaust pipe tip during attachment of the exhaust pipe tip to the exhaust pipe.

2. The support device as defined in claim 1 wherein said outer end portion of said frame member extends angular downwardly and outwardly of the inner end portion at an acute angle with respect to the horizontal to allow the outer end portion to clear the bumper and frame of an automotive vehicle.

3. The support device as defined in claim 1 wherein said exhaust pipe tip support member includes a V-shaped element for engaging and supporting an exhaust pipe tip, an elongate shank affixed to said V-shaped element and projecting through an opening in the outer end portion of the frame member, and means on the frame member engaging said shank for permitting vertical adjustment of the exhaust pipe tip support member.

4. The support device as defined in claim 1 wherein said clamping means on said exhaust pipe attachment member includes a clamping bolt engagable with an exhaust pipe.

5. The support device as defined in claim 1 wherein said clamping means on said attachment member includes a plurality of clamping bolts engagable with an exhaust pipe for clamping the attachment member to an exhaust pipe.

6. A support device for supporting and permitting accurate alignment and attachment of an exhaust pipe tip to an exhaust pipe of an automotive vehicle, a single piece, rigid, elongate frame member having an inner end portion and an outer end portion an attachment member positioned above the inner end portion of the frame member, means pivotally connecting the attachment member to the inner end portion of the frame member for pivoting movement of the attachment member about a vertical axis, clamping means on said attachment member for clamping engagement with an exhaust pipe of vehicle, an adjustable exhaust tip support member for supporting an exhaust tip during replacement thereof, means connecting the exhaust tip support member to the outer end portion of the frame member to support the exhaust tip support member for vertical adjustment and adjustable pivoting movement thereof relative to the frame member whereby the support device may be readily applied to an exhaust pipe for rapid replacement of an exhaust tip.

7. The support device as defined in claim 6 wherein said frame member is of angular configuration and said outer end portion extends downwardly and outwardly from the inner end portion at acute angle with respect to the horizontal when the support device is applied to an exhaust pipe for clearing the bumper and frame member of the vehicle.

8. The support device as defined in claim 6 wherein said exhaust tip support member includes an elongate shank and V-shaped element secured to one end of said shank, said shank being adjustably connected to the outer end portion of the frame member, and said V-shaped element engaging and supporting an exhaust tip during replacement of the exhaust tip.

9. A support device for supporting and permitting accurate alignment and attachment of an exhaust pipe tip to an exhaust pipe of an automotive vehicle, a single piece, rigid, elongate frame member having an inner end portion and an outer end portion, said frame member being of angular configuration and said outer end portion extending downwardly and outwardly from the inner end portion at an acute angle with respect to the horizontal when the support device is applied to an exhaust pipe for clearing the bumper and frame, said inner end portion of the frame member having linear dimension substantially less than the linear dimension of the outer end portion, an attachment member positioned above the inner end portion of the frame member means pivotally connecting the attachment member to the inner end portion of the frame member for pivoting movement of the attachment member about a vertical axis, clamping means on said attachment member for clamping engagement with an exhaust pipe of a vehicle, an adjustable exhaust tip support member for supporting an exhaust tip during replacement thereof, means connecting the exhaust tip support member to the outer end portion of the frame member to support the exhaust tip member for vertical adjustment and adjustable pivoting movement thereof relative to the frame member whereby the support device may be readily applied to an exhaust pipe for rapid replacement of an exhaust tip.

* * * * *